United States Patent [19]

Thompson

[11] 4,235,343

[45] Nov. 25, 1980

[54] CONTAINER ASSEMBLY

[76] Inventor: Harold E. Thompson, 722 Maple Heights Dr., Galien, Ohio 44833

[21] Appl. No.: 61,672

[22] Filed: Jul. 30, 1979

[51] Int. Cl.[3] ..... B65D 21/02

[52] U.S. Cl. ..... 215/6; 215/10

[58] Field of Search ..... 215/10, 6; 220/23.4; 206/501, 504

[56] References Cited

U.S. PATENT DOCUMENTS

| | | | |
|---|---|---|---|
| 251,566 | 12/1881 | Fuller | 215/6 |
| 519,601 | 5/1894 | Dryfoos | 215/6 |
| 529,762 | 11/1894 | Van Wie | 215/6 |
| 2,493,922 | 1/1950 | Miller | 215/6 |
| 2,641,374 | 6/1953 | Der Yuen | 215/10 |
| 3,225,951 | 12/1965 | Poston | 215/6 |
| 3,658,204 | 4/1972 | Bottger | 215/6 X |
| 3,994,408 | 11/1976 | Belitzky | 215/10 |

*Primary Examiner*—Donald F. Norton

*Attorney, Agent, or Firm*—Gust, Irish, Jeffers & Hoffman

[57] ABSTRACT

A container assembly comprising one large and two smaller containers, two opposed wall portions of the large container having cavities therein which receive in sliding relation the smaller containers, respectively. The exposed surfaces of the smaller containers blend with the adjacent surfaces of the wall portions thereby to provide an uninterrupted surface contour on the containers so assembled. The cavities provide indentations by means of which the larger container may be conveniently manually grasped.

2 Claims, 5 Drawing Figures

CONTAINER ASSEMBLY

BACKGROUND OF THE INVENTION

1. Field of the Invention

The present invention relates to nestable containers, and more particularly to a large container having one or more smaller containers removably nested therein.

2. Description of the Prior Art

The concept of nestable and stackable containers is not new, such concepts being disclosed in U.S. Pat. Nos. 59,333; 146,783; 251,566; 353,600; 2,780,225; 3,225,951; 3,391,824; 3,994,408 and 4,139,114. Such prior art containers do not, however, provide an arrangement wherein the smaller containers when nested in the larger one provides an outline of the larger container wherein the outer walls of the larger and smaller containers are flush rendering the overall appearance as being unitary. Further, such prior art arrangements do not provide for cavities within opposite wall portions of the larger container for receiving the smaller containers, respectively, which serve as indentations by means of which the larger container may be manually grasped when the smaller containers are removed therefrom.

SUMMARY OF THE INVENTION

The present invention comprises a large and at least one smaller container, the larger container being provided with a cavity in the wall portion thereof which receives in sliding relation the smaller container. The exposed surface of the smaller container blends with the adjacent surface of the wall portion of the large container thereby to provide an uninterrupted surface contour on the containers so assembled. The larger container may may have two cavities in opposed wall portions thereof adapted to receive in sliding relation two smaller containers, respectively, the shapes of the containers and cavities being orthogonal such that when the containers are assembled, the exposed surfaces are flush with the adjacent surfaces of the larger container. The two cavities within the larger container serve as indentations by means of which the larger container may be conveniently grasped and held in the hand.

It is an object of this invention to provide a container assembly wherein one or more smaller containers may be nested within the wall portion of the larger container thereby to provide an overall, unitary container appearance.

It is another object to provide such a container assembly wherein the container cavities are orthogonally shaped as are the smaller containers thereby to form indentations by means of which the larger container may be manually grasped when the smaller containers are removed therefrom.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
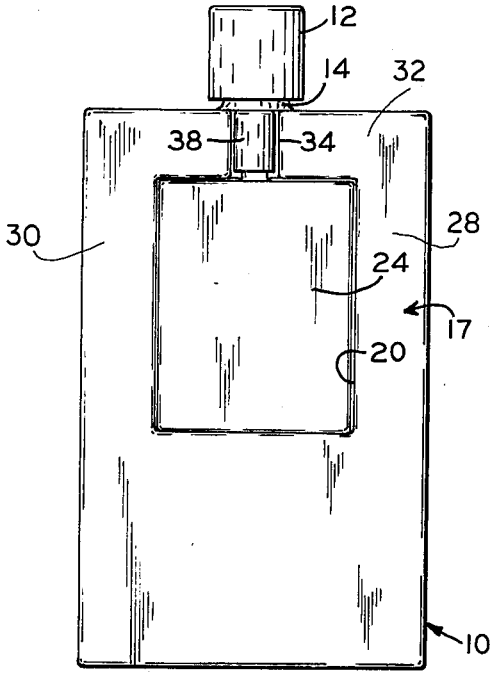
FIG. 1 is a front view of one embodiment of this invention, the rear view having a like appearance.
Figure 2:
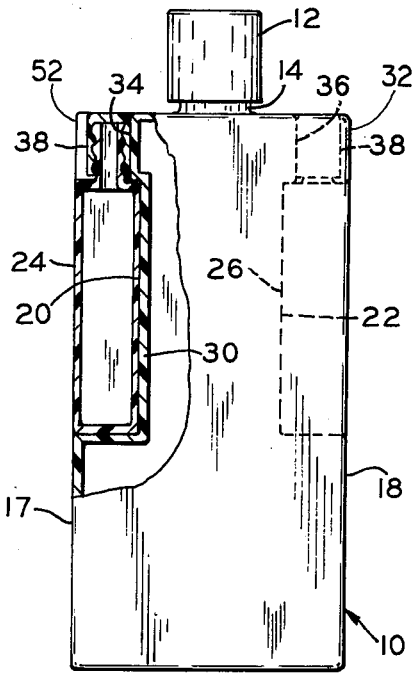
FIG. 2 is a side view partially sectioned longitudinally for clarity of illustration.
Figure 3:
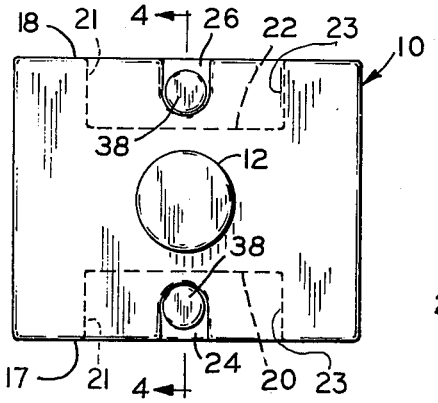
FIG. 3 is a top plan view of the embodiment of the preceding figure.
Figure 4:
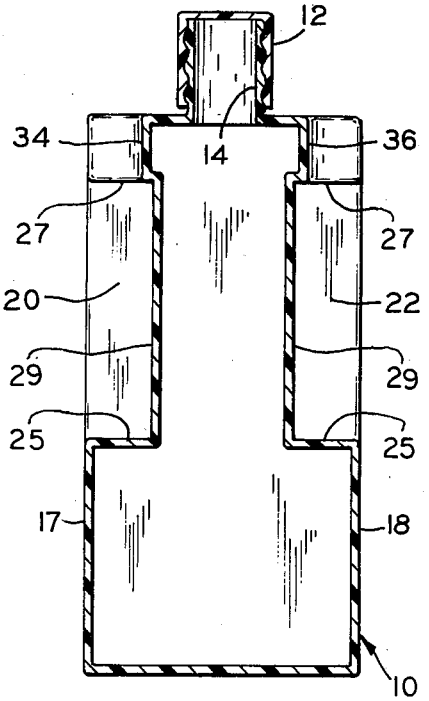
FIG. 4 is a longitudinal sectional view taken substantially along section line 4—4 of FIG. 3 but with the smaller containers removed from the cavities.
Figure 5:
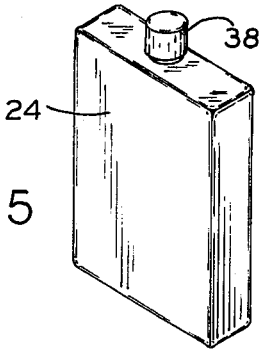
FIG. 5 is a perspective view of one of the smaller containers which is nestable within a respective cavity of the larger container as shown in FIG. 4.

Referring to the drawings, a large container 10 in the form of a bottle made of plastic, glass or metal is indicated by the numeral 10, this container being orthogonally shaped and having a cap 12 removably threaded onto a neck or spout 14. In the opposed walls 17 and 18 of the bottle 10 are two orthogonally shaped cavities 20 and 22, respectively, of equal size, these cavities being adapted to receive in sliding relation two smaller bottles 24 and 26, respectively. Each cavity 20 and 22 has two first walls 21 and 23 which are flat and parallel and two second walls 25 and 27 which are also flat and parallel, the first walls intersecting the second walls at right angles. Further, each cavity has a flat bottom 29 which is at right angles to the walls 23, 25, 27 and 29. The cavities and bottles are proportioned as shown in the drawings, the portions 25, 29 and 27 of the larger bottle 10 surrounding the respective cavities 20, 22 being of substantially equal width as shown. In the portions 27 are provided two U-shaped recesses 34 and 36 which open through the top of the bottle 10 and into the respective cavities 20 and 22. The bottles 24, 26 have threaded caps 38 on the spouts thereof which are received with a close sliding clearance by these recesses, the recesses complementing the caps 38 in size and shape. The bottles 24 and 26 are so sized that when they are nested into the respective cavities 20 and 22, the exposed surfaces thereof are disposed flush with the adjacent wall surfaces of the bottle 10. Thus, the nested assembly has the appearance of a single, unitary bottle.

If it is desired to dispense the liquid contents of the smaller bottles 24 and 26, the bottles are first removed from the respective cavities by placing a finger on the tops of the caps 38 and sliding the bottles from the cavities. The bottles must be sized such that they can be easily withdrawn from the cavities.

With the smaller bottles removed, the two cavities 20 and 22 serve as indentations whereby the larger bottle 10 may be manually grasped between the thumb and fingers of a hand. By reason of the bottle portion 32 serving as an abutment, the bottle 10 is less apt to slide from the grasp. With the bottle 10 inverted, the lower portion of the cavities 20 and 22 as viewed in the drawings also serves as an abutment to assure that the bottle will not slip from the grasp.

For storage purposes, the two smaller bottles 24 and 26 are nested within the respective cavities 20 and 22. The bottles may be filled with any suitable liquids such as mouthwash of different flavors, beverages and the like. The term "orthogonal" or "orthogonally shaped" refers to the right angle or rectangular configurations of the various bottles and cavities shown in the drawings, these as shown also being characterized as rectangular.

While there have been described above the principles of this invention taken in connection with the specific apparatus, it is to be clearly understood that this description is made only by way of example and not as a limitation to the scope of the invention.

What is claimed is:

1. A container assembly comprising a large and at least one smaller container, said large container having four flat sides at right angles to each other and opposite ends that are flat and parallel and intersect said sides at right angles, one side of the large container having a cavity therein which removably receives in nested relation the smaller container, the exposed surface of said smaller container, blending with the adjacent surface of the larger container thereby to provide an uninterrupted surface contour on the containers so assembled, said cavity having two first walls which are flat and parallel and two second walls which are also flat and parallel, the first walls intersecting the second walls at right angles, said cavity further having a flat bottom which is at right angles to said walls, said smaller container having a shape that complements the shape of said cavity, the first walls of said cavity being parallel to two opposite sides of said larger container, the second walls being parallel to the opposite ends, said walls being spaced inwardly from the respective sides and ends 2. The container assembly of claim 1 including a second cavity in the side of said larger container opposite the first cavity, said second cavity having four walls and a bottom disposed relative to said sides and ends the same as those of the first cavity, a second smaller container which complements the shape of said second cavity and has an outer surface flush with said opposite side, each side of said larger container having a recess therein which extends between one of said ends and the respective cavity, and said smaller containers having filler necks and caps which are snugly received by said recesses, respectively.

* * * * *